US010172401B1

(12) United States Patent
Hopper et al.

(10) Patent No.: US 10,172,401 B1
(45) Date of Patent: Jan. 8, 2019

(54) BACKING PLATE FOR MAGNETIC ATTACHMENT

(71) Applicant: Simple Texan LLC, Argyle, TX (US)

(72) Inventors: Richard A Hopper, Bartonville, TX (US); David W. Behoteguy, Brea, CA (US)

( * ) Notice: Subject to any disclaimer, the term of this patent is extended or adjusted under 35 U.S.C. 154(b) by 0 days.

(21) Appl. No.: 15/382,618

(22) Filed: Dec. 17, 2016

(51) Int. Cl.
*A41F 1/00* (2006.01)
*A44C 3/00* (2006.01)

(52) U.S. Cl.
CPC ..... *A41F 1/002* (2013.01); *A44C 3/001* (2013.01)

(58) Field of Classification Search
CPC . A41F 1/002; A44C 3/001; G09F 7/04; G09F 7/00; G09F 2007/1852; G09F 3/02; Y10S 24/906
USPC ..... 24/303
See application file for complete search history.

(56) References Cited

U.S. PATENT DOCUMENTS 4,236,331 A * 12/1980 Mattson ..... A44C 3/001 40/1.5
4,849,340 A * 7/1989 Oberhardt ..... B01F 11/0045 422/110
5,347,733 A * 9/1994 Whittington ..... G09F 7/04 24/303
5,369,899 A * 12/1994 Reeves ..... A44C 3/001 24/303
5,604,960 A * 2/1997 Good ..... A41F 1/002 24/303
5,682,653 A * 11/1997 Berglof ..... G09F 1/10 224/183
6,006,455 A * 12/1999 Miller ..... G09F 7/04 40/1.6
6,367,126 B1 * 4/2002 Rivkin ..... A45F 5/02 24/10 R
6,446,372 B1 * 9/2002 Reeves ..... A44C 3/001 24/303
6,671,986 B2 * 1/2004 Reeves ..... A44C 3/001 40/1.6
7,966,755 B1 * 6/2011 Reeves ..... G01C 17/04 24/303
8,793,846 B2 * 8/2014 d'Auriac ..... A41D 27/08 24/303
D777,841 S * 1/2017 Kott ..... D20/43
2001/0014998 A1 * 8/2001 Grunberger ..... A41F 1/002 24/303
2004/0200043 A1 * 10/2004 Wong ..... A41F 1/002 24/303
2015/0371566 A1 * 12/2015 Kott ..... G09F 3/207 40/1.6

* cited by examiner

*Primary Examiner* — Robert Sandy
*Assistant Examiner* — Rowland Do
(74) *Attorney, Agent, or Firm* — The Law Office of Austin Bonderer, PC; Austin Bonderer

(57) ABSTRACT

A backing plate having a front wall, a rear wall, a magnet, and a magnet retainer. The magnet retainer comprises magnet retainer front wall, and a thin wall that is thinner than the magnet retainer front wall. The magnet is located between the thin wall and the rear wall.

8 Claims, 3 Drawing Sheets

BACKING PLATE FOR MAGNETIC ATTACHMENT

BACKGROUND

The current backing plates for magnetic holders for items such as name tags currently allow for the weight of the external opposing item to rotate downward due to the effect of gravity. Typically the downward rotation causes the item to pull the article of clothing downward resulting in two issues. First being an appearance that can be unsightly. Second being the name tag is not as visible. Another issue that often occurs is that the adhesive that secures the magnets over time deteriorates or loses its hold. Often adhesive becomes brittle once cured, and in turn, when the magnetic force causes a sudden attachment to the opposing magnet, the adhesive can shatter and be rendered irrelevant which causes product failure and risk of injury due to choking hazard increases significantly.

BRIEF DESCRIPTION OF THE DRAWINGS

Implementations of the present technology will now be described, by way of example only, with reference to the attached figures, wherein.

DETAILED DESCRIPTION

Figure 1:
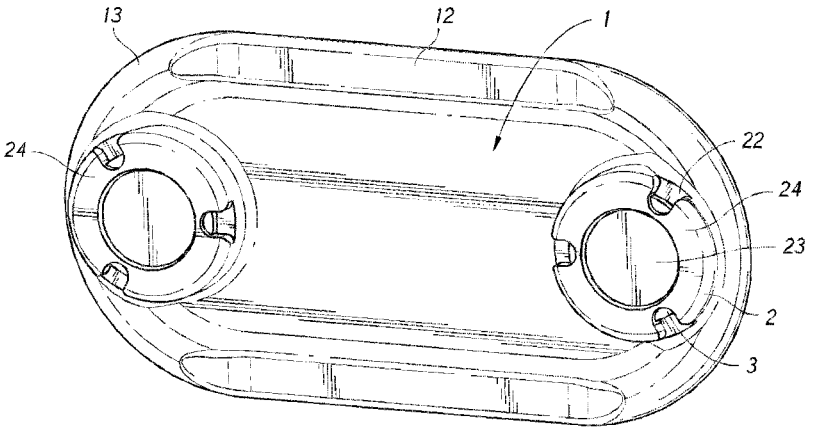
FIG. 1 is a front perspective view of an embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein. It should be noted that references to "an" or "one" embodiment in this disclosure are not necessarily to the same embodiment, and such references mean at least one.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "electrically coupled" is defined as being in structural electrical contact, whether directly or indirectly through intervening components, to allow the flow of electrons between the respective elements. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

Figure 2:
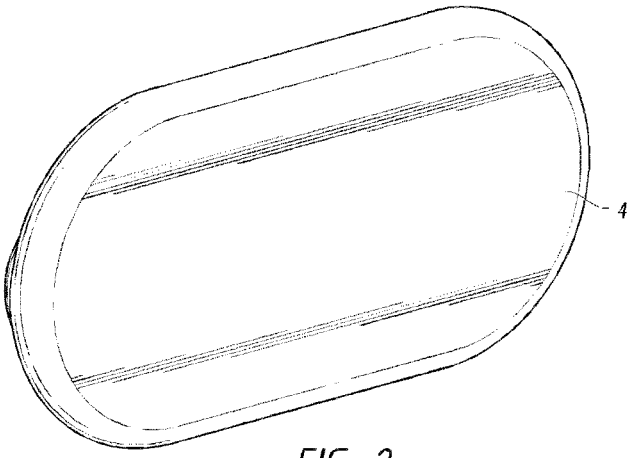
FIG. 2 rear perspective view of an embodiment.
Figure 3:
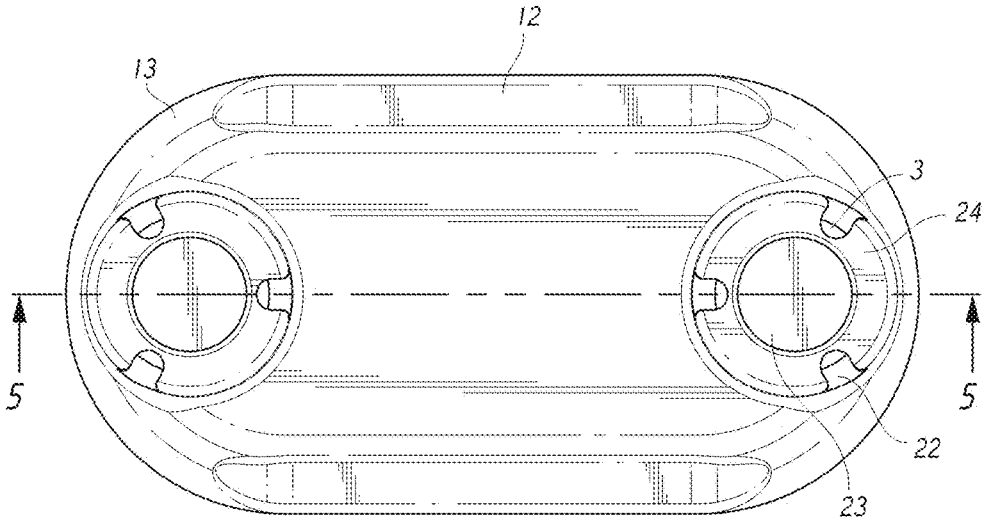
FIG. 3 is a front view of an embodiment.
Figure 4:
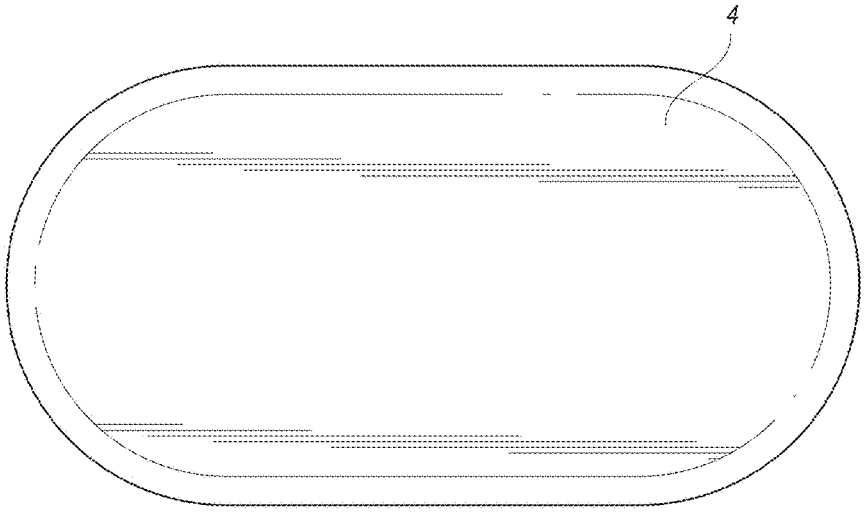
FIG. 4 is a rear view of an embodiment.
Figure 5:
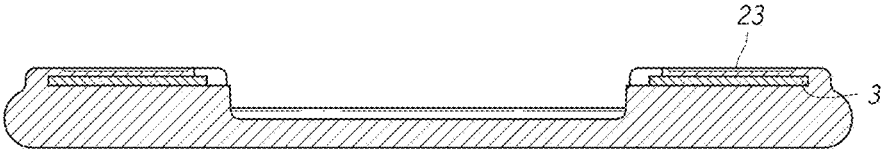
FIG. 5 is a cross-sectional view of an embodiment.
Figure 6:
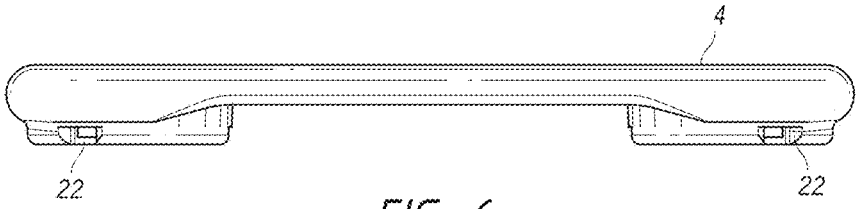
FIG. 6 is a top side view of an embodiment.
Figure 7:
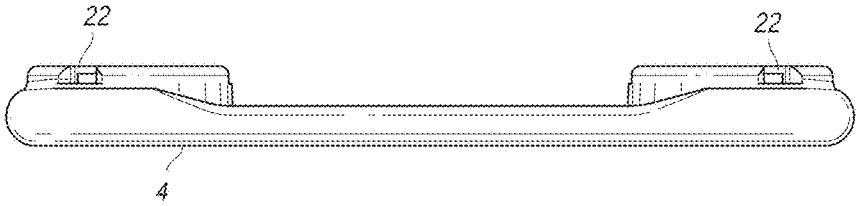
FIG. 7 is a bottom side view of an embodiment.
Figure 8:
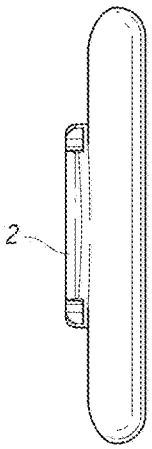
FIG. 8 is a right side view of an embodiment.
Figure 9:
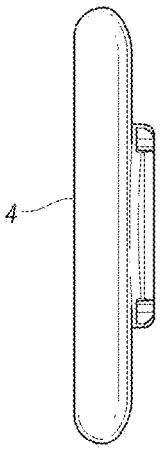
FIG. 9 is a left side view of an embodiment.

Referring to FIGS. 1-9, a backing comprising a front wall 1, also known as a front surface, a magnet retainer 2, a magnet 3, and a rear wall 4, also known as a rear surface. The magnet retainer 2 comprises one of more magnet retainer slots 22 and defines a thin wall 23. The magnet 3 resides in the magnet retainer 2 to which it is exposed. The magnet retainer 2 is located adjacent to the front wall 1.

The backing can have a length of about 4.356 centimeters (about 1.715 inches) to about 6.35 centimeters (about 2.500 inches); a width of about 2.245 centimeters (about 0.884 inches) to about 3.81 centimeters (about 1.500 inches); and a magnet center to center width of about 3.091 centimeters (about 1.217 inches) to about 5.093 centimeters (about 2.005 inches).

The width of the backing versus the length provides a greater resistance torque to the common rotation of items attached to the backing. The strength of the fabric to resist rotation is typically consistent over the fabric. Thus it has been found that by increasing the width, with the constant resistance provided by the fabric, less rotation is seen when using the front wall 1. The resistive torque is increased without altering the fabric by moving the point of contact further away from the axis of rotation. In some embodiments, the axis of rotation is defined by the center point of the magnets 3. In other embodiments, the center of rotation will be determined by the object secured by the back plate.

Another aspect of the back plate is that the magnet retainer front wall 24 has is thin and defines the thin wall 23. As can be seen in embodiment shown in FIG. 5, the thin wall is integral with the magnet retainer front wall 24. As is well known, the attraction between a magnet and a ferromagnetic material or a second magnet is dependent on the distance between the two objects as well as any other material that comes between the magnet and ferrous material or other magnet. The further away a magnet is from an object, the less the attraction between them, and vice versa. While there are many different formulas for magnetic attraction, most, if not all, show a decrease in attraction as distance increases. One of the most basic formulas for the magnetic force is:

$$F=(\mu qm_1*\mu qm_2)/(4\pi r^2)$$

Wherein F is force; qm1 and qm2 are the magnitudes of magnetic poles; μ is the permeability of the intervening medium; and r is the separation.

To better secure the back plate, the magnets 3 had to be as close as possible to the object being secured. However, there is the issue of properly securing the magnets 3 to the backing for long time use. Thus it was found that the magnet retainer front wall 24 with the thin wall 23 accomplishes both. The magnet retainer front wall 24 secures the magnet 3 with a long term durability, much longer than an adhesive. The thin wall 23 allows for the magnet 3 to be closer in use than if fully enveloped by the magnet retainer front wall 24. As made clear from the formula above, the permeability of the intervening medium increases the force. Thus by decreasing the thickness of the medium, like the thin wall 23 does, the force has been increased. It has been found that when the backing is used on a fabric, the fabric gives a bit and allows the magnet 3, via the thin wall 23, to get closer to the magnet or ferromagnetic material on the secured object. As shown above, the distance between the magnets has an effect of being squared in the denominator. Thus a small amount of distance change can have a great effect on the force. However even if the distance is not decreased by the thin wall 23, the permeability, and thus the force, will be increased. In some embodiments, the thin wall 23 has a thickness in the range of, and including, 0.03302 centimeter (0.013 inches)-0.0381 centimeter (0.015 inches).

Some embodiments will also have a ridge 13 and a groove 12. The ridge 13 can extend around the entire or partially around the front wall 1. The ridge 13 helps engage the fabric for a more secure fit. In some embodiments, a groove 12 will extend partially about the periphery of the front wall 1. Embodiments comprising a groove 12 allow for bulkier items to be secured to the back plate. In one embodiment, the backing is to be used for a magnetic eyeglass holder as taught by U.S. Pat. No. 6,367,126, incorporated here by reference. Sometimes bulky eyeglasses will be better accommodated by backing comprising a groove 12.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

It should also be noted that elements of embodiments may be described in reference to the description of a particular embodiment; however it is disclosed that elements of disclosed embodiments can be switched with corresponding elements of embodiments with the same name and/or number of other disclosed embodiments.

Depending on the embodiment, certain steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. An apparatus comprising:

a backing plate comprising:

a front surface;

a rear surface opposite the front surface;

a magnet; and a magnet retainer;

wherein the magnet retainer comprises a magnet retainer front wall and a thin wall that is thinner than the magnet retainer front wall; the thin wall and the magnet retainer front wall are integral; and the magnet is retained by the magnet retainer and is located between the thin wall and the rear surface.

2. The apparatus of claim 1, wherein the thin wall has a thickness in a range of about 0.03302 centimeter (about 0.013 inches) up to and including 0.0381 centimeter (0.015 inches).

3. The apparatus of claim 1, wherein the magnet retainer front wall defines one or more magnet retainer slots.

4. The apparatus of claim 1, further comprising a ridge located on at least a portion of a periphery of the front surface.

5. The apparatus of claim 4, wherein the ridge defines a groove on at least a portion of the periphery.

6. The apparatus of claim 1, wherein the backing plate has have a length of about 4.356 centimeters (about 1.715 inches) to about 6.35 centimeters (about 2.500 inches).

7. The apparatus of claim 1, wherein the backing plate has a width of about 2.245 centimeters (about 0.884 inches) to about 3.81 centimeters (about 1.500 inches).

8. The apparatus of claim 1, further comprising a second magnet, and a magnet center to center width of about 3.091 centimeters (about 1.217 inches) to about 5.093 centimeters (about 2.005 inches).

* * * * *